US006910870B2

(12) United States Patent
Ebner

(10) Patent No.: US 6,910,870 B2
(45) Date of Patent: Jun. 28, 2005

(54) HIGH TEMPERATURE POTHEAD

(75) Inventor: Paul Ebner, Shawnee, KS (US)

(73) Assignee: Schlumberger Technology Corporation, Sugar Land, TX (US)

( * ) Notice: Subject to any disclaimer, the term of this patent is extended or adjusted under 35 U.S.C. 154(b) by 81 days.

(21) Appl. No.: 10/324,459

(22) Filed: Dec. 20, 2002

(65) Prior Publication Data

US 2004/0120837 A1 Jun. 24, 2004

(51) Int. Cl.[7] ..... F04B 17/00; E21B 29/02; H01R 13/40; H01R 13/625

(52) U.S. Cl. ..... 417/422; 417/423.3; 166/65.1; 439/589; 439/874

(58) Field of Search ..... 439/281, 282, 439/587, 589, 874, 588, 592; 417/422, 313, 423.3; 166/68.5, 105, 65.1

(56) References Cited

U.S. PATENT DOCUMENTS 2,897,763 A * 8/1959 Wright ..... 417/360
3,126,831 A * 3/1964 Deters ..... 417/359
3,786,397 A 1/1974 Bridges
4,128,735 A * 12/1978 Zehren ..... 174/65 R
4,330,166 A * 5/1982 Cooper et al. ..... 439/609
4,523,899 A * 6/1985 Ouchi ..... 417/360
4,626,175 A * 12/1986 Riback et al. ..... 417/40
4,927,386 A * 5/1990 Neuroth ..... 439/589
5,113,101 A * 5/1992 Liu et al. ..... 310/87
5,286,220 A 2/1994 Watson
5,627,343 A * 5/1997 Brandolf ..... 174/153 R
5,670,747 A * 9/1997 Lawer et al. ..... 174/74 R
5,700,161 A 12/1997 Plummer et al.
5,762,135 A * 6/1998 Moore ..... 166/65.1
6,361,342 B1 3/2002 Cox
6,397,945 B1 * 6/2002 Manke et al. ..... 166/65.1
6,409,485 B1 6/2002 Ebner

FOREIGN PATENT DOCUMENTS

GB 2338119 A 8/1999

* cited by examiner

*Primary Examiner*—Cheryl Tyler
*Assistant Examiner*—Timothy P. Solak
(74) *Attorney, Agent, or Firm*—Van Someren, P.C.; Jaime A. Castano; Dale Gaudier

(57) ABSTRACT

The present invention provides a high temperature pothead used to provide power to a submersible motor. More specifically, the present invention provides a high temperature pothead that does not require elastomeric sealing elements.

16 Claims, 3 Drawing Sheets

HIGH TEMPERATURE POTHEAD

FIELD OF THE INVENTION

The present invention relates generally to a high temperature pothead used to provide power to a submersible component such as a submersible motor. More particularly, the present invention provides a high temperature pothead that does not require elastomeric sealing elements.

BACKGROUND OF THE INVENTION

In a variety of applications, it is necessary to form liquid-tight seals between an electrical power cable and a component. For example, in subsurface production of liquids, such as oil, it may be necessary to provide electrical power to an electric submersible pumping system. Typically, a power cable is run downhole and connected to a submersible electric motor. The electric motor is powered to turn a centrifugal pump that intakes the production fluid and raise it or move it to a desired location, such as the surface of the earth.

In such applications, the electric submersible pumping system often is utilized within a wellbore at a location deep beneath the surface of the earth. In that type of environment, components are subjected to extreme pressures, extreme temperatures, and often corrosive environments. Thus, it can be difficult to form a lasting, fluid-tight seal between the power cable and the submersible component, e.g. submersible motor.

In conventional connectors, e.g. potheads, the conductors of the power cable are disposed through a connector housing and through the outer housing of the submersible component for appropriate connection. Within the connector housing, a plurality of blocks are used to support the individual conductors. Typically, an elastomeric block or blocks is disposed between a pair of relatively hard blocks. The hard blocks are utilized to squeeze the elastomeric block until it forms a seal between the individual conductors and the interior surface of the connector housing. Additional elastomeric seals are used to prevent fluid flow between the connector and the submersible component housing.

The elastomers used to form the seals are subject to degradation from thermal exposure, compression set due to thermal cycling (i.e. system starts and stops), and $H_2S$ gas transmission. When providing power in an environment having very high operating temperatures, the seals expand and exert great pressure on the conductor insulation which can result in the insulation tearing and opening a path to ground.

There exists, therefore, a need for a high temperature pothead that does not utilize elastomeric seals.

DETAILED DESCRIPTION OF PREFERRED EMBODIMENTS

Figure 1:
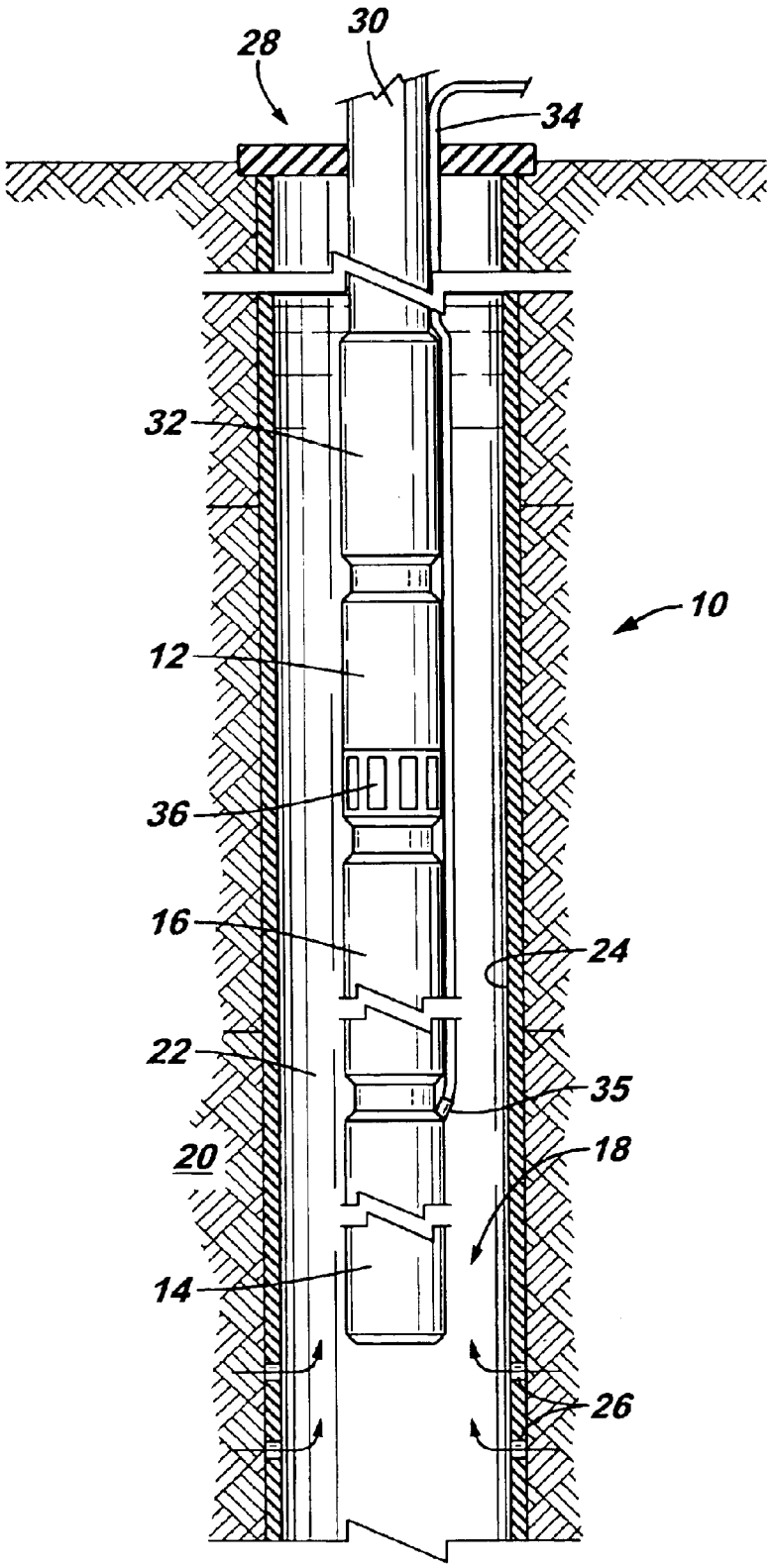
FIG. 1 is a front elevational view of a typical submersible pumping system disposed within a wellbore and powered via a multiconductor power cable.

Referring generally to FIG. 1, an exemplary, high-pressure, high temperature environment is illustrated. The high temperatures and pressures in wellbore environments often can be above 150 degrees Fahrenheit and 3000 pounds per square inch (psi), respectively, and in many applications, the wellbore environment can exceed high temperatures and high pressures of 300 degrees Fahrenheit and 10,000 psi, respectively. In this particular application, a power cable is coupled to a submersible pumping system in a downhole, wellbore environment by a connector, e.g. pothead. The pumping system may be an electric submersible pumping system 10. Typically, the system 10 includes at least a submersible pump 12, such as a centrifugal pump, a submersible motor 14 and a motor protector 16.

In the illustrated example, the pumping system 10 is designed for deployment in a well 18 within a geological formation 20 containing desirable production fluids, such as petroleum. In a typical application, a wellbore 22 is drilled and lined with a wellbore casing 24. The wellbore casing 24 may include a plurality of openings 26 through which production fluids may flow into the wellbore 22.

The pumping system 10 is deployed in the wellbore 22 by a deployment system 28 that may have a variety of forms and configurations. For example, the deployment system 28 may comprise tubing 30 connected to the pump 12 by a connector 32. Power is provided to the submersible motor 14 via a power cable 34 coupled to a submersible component, e.g., the motor 14, by a power cable connector or a pothead 35. The motor 14, in turn, powers the centrifugal pump 12 which draws production fluid in through a pump intake 36 and pumps the production fluid to the surface via the tubing 30.

It should be noted that the illustrated submersible pumping system 10 is merely an exemplary system. Other components can be added to the system, and other deployment systems may be implemented. Additionally, the production fluids may be pumped to the surface through the tubing 30 or through the annulus formed between the deployment system 28 and the wellbore casing 24. Also, the power cable 34 may be coupled to other submersible components.

The present invention provides a high temperature connector 35 particularly advantageous in high temperature environments. The high temperature connector 35 of the present invention does not use elastomeric seals and thus avoids any detrimental effects caused by exposing the elastomers to very high operating temperatures.

Figure 2:
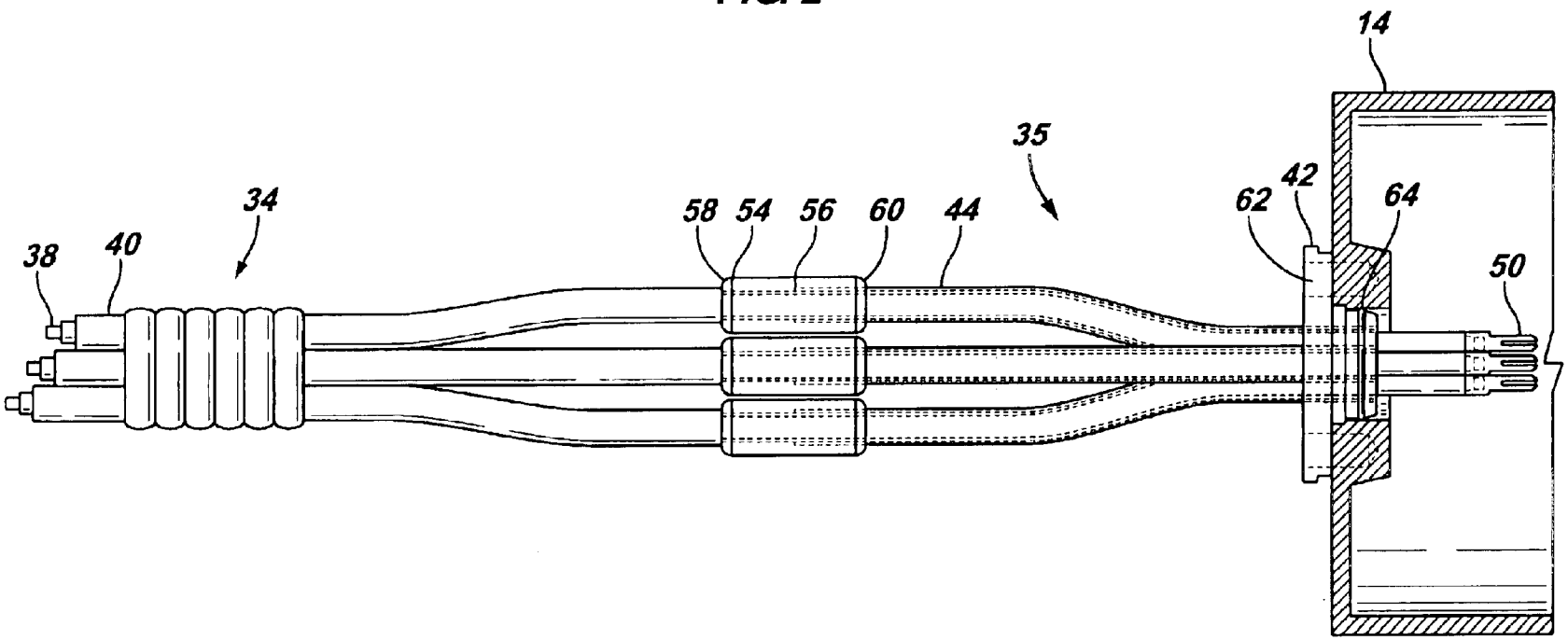
FIG. 2 is a side view showing in partial cross-section an embodiment of the high temperature connector of the present invention providing a connection between a power cable and a submersible component, e.g., submersible motor.
Figure 3:
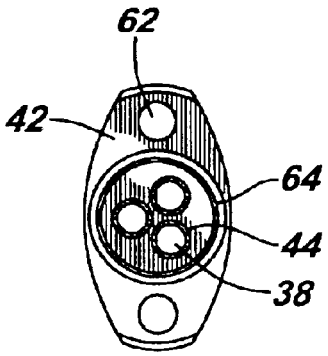
FIG. 3 is an end view of an embodiment of the high temperature connector of the present invention.

Referring back to FIGS. 2 and 3, the pothead seal flange 42 fits into the motor-head pothole after the brush-wires are crimped and taped on. The pothead seal flange 42 has a pair of axial holes 62 formed therethrough. The axial holes 62 are designed to receive conventional fasteners, such as bolts, that are threadingly engaged with the housing of the submersible component 14. The pothole seal may be made with a Metal Spring Energized (MSE) seal 64 of the type, for example, that utilizes a corrosion-resistant metal spring placed under compression between a portion of seal flange 42 and the housing of submersible component 14.

The power cable 35 includes one or more conductors 38. A lead jacket 40 is extruded onto the conductors 38 of the power cable 35 to form a protective barrier. In the illustrated embodiment, the power cable 34 has three conductors 38 for carrying three-phase power to a submersible component, such as the motor. Of course, a variety of other power cables may be utilized for providing electrical power to a variety of components.

The high temperature connector 35 of the present invention comprises a pothead seal flange 42 and one or more conductor tubes 44. The number of conductor tubes 44 typically corresponds with the number of conductors 38 existing within the power cable 34. The conductor tubes 44 are welded into the pothead seal flange 42 to form a path for each conductor 38 to feed through. In an embodiment of the present invention, the pothead seal flange 42 and the conductor tubes 44 are formed from Monel 400.

Figure 4:
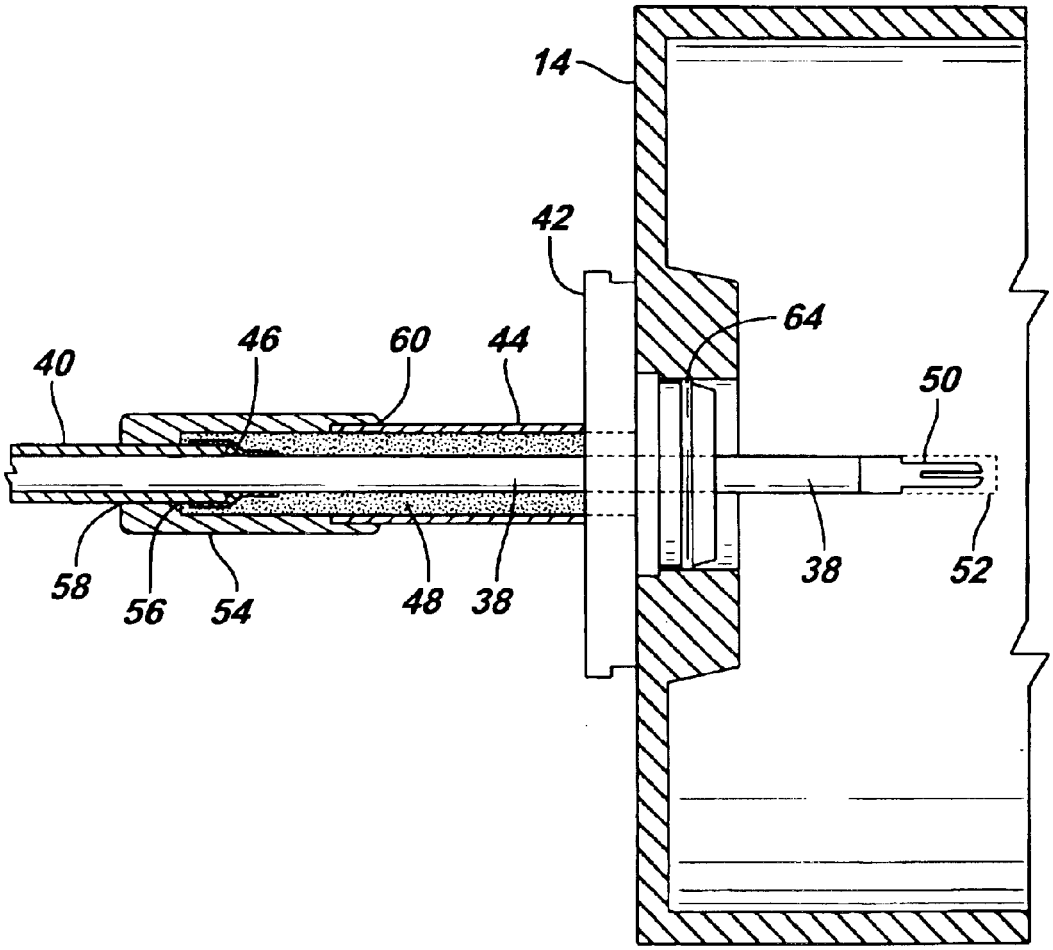
FIG. 4 provides a side cross-sectional view of an embodiment of the high temperature connector of the present invention.

As best described with reference to FIG. 4, prior to inserting the conductors 38 into the conductor tubes 44, the lead jacket 40 on each cable conductor 38 is removed back to an appropriate location, taped off with high modulus PTFE tape 46, and soldered to the inside of the conductor tubes 44 with solder paste 48. The conductors 38 are inserted into the conductor tubes 44 such that they protrude through the pothead seal flange 42 and are terminated via a plurality of terminals 50. The terminals 50 are designed for plugging engagement with corresponding receptacles 52 of the submersible component as shown in dashed lines in FIG. 4.

Once the conductors 38 have been soldered to the inside of the conductor tubes 44, oversized, lead splice tubes 54 are slit and placed around and over the junctions between the conductor tubes 44 and the lead jackets 40. The open edges of the lead splice tubes 54 are then pinched upward and together to bring the lead splice tubes 54 into engagement with the conductors 38. The excess of the lead splice tubes 54 are trimmed off and the tubes 54 are soldered in place, forming metal-metal seals 56 between the conductor tubes 44 and the lead jackets 40.

The lead splice tubes 54 are soldered in place at both the junctions 58 of the lead splice tubes 54 and the lead jackets 40 and at the junctions 60 of the lead splice tubes 54 and the conductor tubes 44.

The lead/lead soldering at the junctions 58 between the lead splice tubes 54 and the lead jackets 40 is actually a welding process. The material on either side of the joint melts and fuses together. Thus, there is no need to rely on a wetted solder joint.

The lead/conductor tube soldering at the junctions 60 between the lead splice tubes 54 and the conductor tubes 44 is a high temperature solder joint. In embodiments of the high temperature connector 35 using Monel as the conductor tubes 44, the solder joint can be made with 95/5 rod solder, 88/10/2 paste solder, or 95/5 paste solder, for example.

It should be understood that the conductor seal 56 of the high temperature connector 35 of the present invention can be moved farther from the back of the pothead seal flange 42 by increasing the length of the conductor tubes 44. As the distance from the pothead seal flange 42 increases, to a point, the operating temperature decreases. Thus, locating the conductor seal 56 distant from the pothead seal flange 42 will act to lower the overall operating temperature to which the conductor seal 56 is exposed.

Referring back to FIGS. 2 and 3, the pothead seal flange 42 fits into the motor-head pothole after the brush-wires are crimped and taped on. The pothead seal flange 42 has a pair of axial holes 62 formed therethrough. The axial holes 62 are designed to receive conventional fasteners, such as bolts, that are threadingly engaged with the housing of the submersible component 14. The pothole seal is made with a Metal Spring Energized (MSE) seal 64.

It should be understood that embodiments of the high temperature connector 35 of the present invention can be used to advantage for a single conductor connection by varying the geometry of the pothead seal flange 42 and the motor-head. The present invention can also work as a plug-in for either a single conductor or regular, three conductor pothead.

The invention being thus described, it will be obvious that the same may be varied in many ways. Such variations are not to be regarded as a departure from the spirit and scope of the invention, and all such are intended to be included within the scope of the following non-limiting claims.

What is claimed is:

1. A high temperature connector adapted to sealingly connect a power cable having one or more conductors to a powered component, comprising:

a flange adapted for connection to the powered component;

one or more metal conductor tubes affixed to the flange and extending away from the powered component, the metal conductor tubes adapted to receive the one or more conductors therethrough; and one or more metal sleeves adapted to provide a sealed connection between the one or more metal conductor tubes and the power cable, wherein the one or more metal conductor tubes are of sufficient length to space the sealed connection at a distance from the flange such that the sealed connection is not exposed to an operating temperature of the powered component.

2. The high temperature connector of claim 1, wherein the powered component is a submersible motor.

3. The high temperature connection of claim 1, further comprising a metal spring energized seal intermediate the flange and the powered component.

4. The high temperature connector of claim 1, wherein the flange is made from a nickel-cooper alloy.

5. The high temperature connector of claim 1, wherein the one or more conductor tubes are made from a nickel-copper alloy.

6. The high temperature connector of claim 1, wherein the one or more conductor tubes are welded to the flange.

7. The high temperature connector of claim 1, wherein the one or more conductors are soldered to the inside of the one or more metal conductor tubes.

8. A high temperature connector adapted to sealingly connect a power cable having one or more conductors to a powered component, comprising:

a flange adapted for connection to the powered component;

one or more conductor tubes affixed to the flange and extending away from the powered component, the conductor tubes adapted to receive the one or more conductors therethrough; and one or more sleeves adapted to provide a sealed connection between the one or more conductor tubes and the power cable, wherein the one or more conductor tubes extend away from the powered component to a location having a lower temperature than the temperature at the location of the flange.

9. A high temperature connector adapted to sealingly connect a power cable having one or more conductors to a powered component, comprising:

a flange adapted for connection to the powered component;

one or more conductor tubes affixed to the flange and extending away from the powered component, the conductor tubes adapted to receive the one or more conductors theretbrough; and one or more sleeves adapted to provide a sealed connection between the one or more conductor tubes and the power cable, wherein the one or more conductor tubes extend away from the powered component to a location having a lower temperature than the temperature at the location of the flange, and further wherein the one or more sleeves provide metal-metal seals.

10. A high temperature connector adapted to sealingly connect a power cable having one or more conductors to a powered component, comprising:

a flange adapted for connection to the powered component;

one or more conductor tubes affixed to the flange and extending away from the powered component, the conductor tubes adapted to receive the one or more conductors therethrough; and one or more sleeves adapted to provide a sealed connection between the one or more conductor tubes and the power cable, wherein the one or more sleeves are soldered in place around the power cable and the one or more conductor tubes, further wherein the one or more conductor tubes are of sufficient length to space the sealed connection at a distance from the flange such that the sealed connection is not exposed to an operating temperature of the powered component.

11. A submersible pumping system, comprising:

a submersible pump;

a submersible motor to power the submersible pump;

a power cable having one or more conductors; and a high temperature connector adapted to connect the power cable to the submersible motor, the high temperature connector comprising a flange adapted for connection to the submersible motor, one or more tubes affixed to the flange and extending away from the submersible motor, wherein the one or more tubes are adapted to sealingly receive the one or more conductors of the power cable, further comprising one or more sleeves adapted to provide metal-metal seals between the one or more tubes and the power cable, wherein the one or more tubes extend away from the submersible motor to a location having a lower temperature than the temperature at the location of the flange.

12. The submersible pumping system of claim 11, further comprising a metal spring energized seal to provide sealing engagement between the flange and the submersible motor.

13. A method for providing a sealed connection between a power cable having one or more jacketed conductors and a submersible component, comprising:

providing a pothead seal flange adapted for connection to the submersible component, the pothead seal flange having one or more conductor tubes extending therefrom;

removing a portion of the jacket from the one or more conductors and inserting the portion of the one or more conductors having the jacket removed through the one or more conductor tubes;

soldering the portion of the one or more conductors having the jackets removed to the inside of the one or more conductor tubes; and providing one or more splice tubes around the one or more junctions between the one or more conductor tubes and the one or more jacketed conductors, wherein the one or more splice tubes provide metal-metal seals disposed at a distance from the submersible component such that the metal-metal seals are subjected to a lower operating temperature than the operating temperature at the pothead seal flange.

14. The method of claim 13, further comprising providing a metal spring energized seal intermediate the pothead seal flange and the submersible component.

15. The method of claim 13, further comprising taping off with a polytetrafluoroethylene tape the junction of the one or more jacketed conductors and the portion of the one or more jacketed conductors having the jackets removed.

16. The method of claim 13, further comprising soldering the first ends of the one or more splice tubes to the one or more jacketed conductors and soldering the second ends of the one or more splice tubes to the one or more conductor tubes.

* * * * *